US006636608B1

(12) United States Patent
Kishii et al.

(10) Patent No.: US 6,636,608 B1
(45) Date of Patent: Oct. 21, 2003

(54) PSEUDO-STEREO CIRCUIT

(76) Inventors: Tatsuya Kishii, c/o Yamaha Corporation, of 10-1, Nakazawa-cho, Hamamatsu-shi Shizuoka-ken (JP), 430; Masao Noro, c/o Yamaha Corporation, of 10-1, Nakazawa-cho, Hamamatsu-shi (JP), 430

( * ) Notice: Subject to any disclaimer, the term of this patent is extended or adjusted under 35 U.S.C. 154(b) by 0 days.

(21) Appl. No.: 09/185,102

(22) Filed: Nov. 3, 1998

(30) Foreign Application Priority Data

Nov. 4, 1997 (JP) ..... 9/302183

(51) Int. Cl.[7] ..... H04R 5/00
(52) U.S. Cl. ..... 381/18; 381/17; 381/1
(58) Field of Search ..... 381/1, 17, 18, 381/19, 20, 21, 22, 61–63

(56) References Cited

U.S. PATENT DOCUMENTS 5,604,809 A * 2/1997 Tsubonuma
5,671,287 A * 9/1997 Gerzon
5,844,993 A * 12/1998 Ilda et al.
6,173,061 B1 * 1/2001 Norris et al.
6,292,570 B1 * 9/2001 Aarts

FOREIGN PATENT DOCUMENTS

JP 361046700 A * 3/1986
JP 407099700 A * 4/1995

* cited by examiner

*Primary Examiner*—Duc Nguyen

(57) ABSTRACT

A pseudo-stereo circuit is provided which processes an input monophonic signal into stereophic audio signals. A phase-shift circuit shifts a phase of the input monophonic signal by a phase shift amount that depends upon a frequency of the monophonic signal, to produce an output signal having a gain with respect to the input monophonic signal which is equal to or larger than a predetermined level over an entire frequency band thereof, and reaches a peak at a frequency at which the phase shift amount of the output signal with respect to the input monophonic signal assumes a value equal or closer to $-\pi$. A mixing circuit produces a first mixed signal by mixing a signal obtained by inverting a phase of the output signal of the phase-shift circuit with the input monophonic signal by a first mixing ratio, and produces a second mixed signal obtained by mixing the output signal of the phase-shift circuit with the input monophonic signal by a second mixing ratio. The mixing circuit generates the first mixed signal as a first audio signal carried by one of left and right channels that provide stereophonic audio signals, and generates the second mixed signal as a second audio signal carried by the other of the left and right channels.

12 Claims, 5 Drawing Sheets

PSEUDO-STEREO CIRCUIT

BACKGROUND OF THE INVENTION

1. Field of the Invention

The present invention relates to a pseudo-stereo circuit for converting monophonic audio signals into stereophonic audio signals.

2. Prior Art

FIG. 1 shows an example of a conventional pseudo-stereo circuit. The pseudo-stereo circuit is principally comprised of L-channel phase-shift circuit 100L and R-channel phase-shift circuit 100R for shifting the phase of a monophonic audio signal Min, to generate respective output signals, and a stereo coordination circuit 200 that receives the output signals of the phase-shift circuits 100L and 100R, and produces stereophonic audio signals carried by two channels, i.e., L and R channels.

The L-channel phase-shift circuit 100L includes, for example, three all-pass filters 101L, 102L and 103L that are cascade-connected in this order. Similarly, the R-channel phase-shift circuit 100R includes three all-pass filters 101R, 102R, and 103R similar in structure to the filters 101L, 102L and 103L, that are cascade-connected in this order. Each of these all-pass filters will be described in detail below.

The all-pass filter 101L is comprised of an operational amplifier 301, resistors 302–304, and a capacitor 305, that are connected in the manner as shown in FIG. 1. The resistors 303 and 304 have the same resistance value. Accordingly, the input voltage Vn of the inverting input terminal (−) of the operational amplifier 301 is given by the following expression (1):

$$Vn=(\mathrm{Min}+Vo)/2 \tag{1}$$

where Vo is the output voltage of the operational amplifier 301.

On the other hand, the input voltage Vp of the noninverting input terminal (+) of the operational amplifier 301 is given by the following expression (2):

$$Vp=\mathrm{Min}/(1+j\omega C1R1) \tag{2}$$

where R1 represents the resistance value of the resistor 302, C1 the capacitance value of the capacitor 305, and ω the angular frequency of the input monophonic signal Min.

In the circuit arrangement shown in FIG. 1, since the inverting input terminal (−) and noninverting input terminal (+) of the operational amplifier 301 are virtually short-circuited to each other due to negative-feedback operation of the circuit, the input voltage Vp becomes equal to the input voltage Vn, and the following expression (3) is established:

$$(\mathrm{Min}+Vo)/2=\mathrm{Min}/(1+j\omega C1R1) \tag{3}$$

By transforming the above expression (3), the transfer function of the all-pass filter 101L is obtained as follows:

$$\begin{aligned} H &= Vo/\mathrm{Min} \\ &= (1-j\omega C1R1)/(1+j\omega C1R1) \end{aligned} \tag{4}$$

Thus, the gain G of the all-pass filter 101L with respect to the input monophonic signal Min is obtained from the above expression (4), and expressed by:

$$\begin{aligned} G &= |H| \\ &= |(1-j\omega C1R1)/(1+j\omega C1R1)| \\ &= |(1-j\omega C1R1)|/|(1+j\omega C1R1)| \\ &= 1 \end{aligned} \tag{5}$$

Accordingly, the input monophonic signal Min of any level of frequency passes through the all-pass filter 101L while keeping its amplitude at the same value.

The phase of the input monophonic signal Min is shifted when the signal passes through the all-pass filter 101L. The phase shift amount or phase angle θ is determined depending upon the frequency of the input signal Min, as shown in the following expression (6):

$$\begin{aligned} \theta &= arg(H) \\ &= -2\tan^{-1}(\omega C1R1) \end{aligned} \tag{6}$$

The all-pass filter 101L has the above described construction and frequency characteristics.

The other all-pass filters 102L and 103L subsequent to the all-pass filter 101L have exactly the same structure as the all-pass filter 101L. As is apparent from the above expression (6), the phase shift amount given by each of the all-pass filters 101L–103L to the input monophonic signal Min varies from 0 to −π, as the frequency f=ω/2π changes. Accordingly, the phase shift amount given by the L-channel phase-shift circuit 100L as a whole to the input signal Min varies from 0 to −3π as the frequency f of the input signal changes. The phase shift amount θL given by the whole L-channel phase-shift circuit 100L is illustrated in FIG. 2.

The R-channel phase-shift circuit 100 R has basically the same structure as the L-channel phase-shift circuit 100L as explained above, but the resistance value of the resistor 302 and the capacitance value of the capacitor 305 of each of the all-pass filters 101R–103R are different from the values R1 and C1 of the all-pass filters 101L–103L, such that, as shown in FIG. 2, the curve representing the frequency characteristic of the phase shift amount θR of the R-channel phase-shift circuit 100R as a whole is shifted with respect to the curve representing the frequency characteristic of the phase shift amount θL of the L-channel phase-shift circuit 100L in the direction of the X-axis representing the frequency of the input signal.

By appropriately selecting the resistance value of the resistor 302 and the capacitance value of the capacitor 305 in each of the L-channel phase-shift circuit 100L and R-channel phase-shift circuit 100R, a difference (θL−θR) between the phase shift amounts of these circuits 100L, 100R can be controlled to approximately π/2 over almost the entire audio frequency band, as shown in FIG. 2. In the circuit shown in FIG. 1, the resistance and capacitance values are suitably selected so that the above requirement is satisfied.

In the circuit arrangement shown in FIG. 1, therefore, the L-channel phase-shift circuit 100L and the R-channel phase-shift circuit 100R output respective audio signals whose phases are shifted with respect to the phase of the input monophonic signal Min and are different from each other by π/2.

The stereo coordination circuit 200 functions to produce stereophonic audio signals based on the respective output signals of the L-channel phase-shift circuit 100L and R-channel phase-shift circuit 100R as explained above. The stereo coordination circuit 200 is comprised of a subtracter 201, a filter 202, an adder 203 and a subtracter 204. In the thus constructed stereo coordination circuit 200, the subtracter 201 produces a signal corresponding to a difference between the output signals of the L-channel phase-shift circuit 100L and the R-channel phase-shift circuit 100R, and the filter 202 limits the frequency range of the output signal of the subtracter 201. The adder 203 performs addition of the output signal of the filter 202 and the output signal of the L-channel phase-shift circuit 100L. The subtracter 204 performs subtraction between the output signal of the filter 202 and the output signal of the R-channel phase-shift circuit 100R. The adder 203 and the subtracter 204 then generate stereophonic audio signals carried by two channels, or L and R channels, so as to produce sound that affords the listener a sense of the spatial distribution of the sound sources.

When the above-described pseudo-stereo circuit is produced as an integrated circuit or IC, the resulting IC chip has a relatively large area since the circuit requires a large number of constituent components, such as operational amplifiers. Also, the known pseudo-stereo circuit requires six capacitors only in the phase-shift circuits for the L and R channels, and these capacitors are generally required to have large capacitance values. It is, therefore, difficult to form these capacitors on the IC board, in view of the limitation of the chip area, and the capacitors need to be provided outside the IC chip, resulting in an increased number of pins needed to be used in the IC. Under these circumstances, the known pseudo-stereo circuit suffers from undesirably high manufacturing cost.

SUMMARY OF THE INVENTION

It is therefore an object of the invention to provide an inexpensive pseudo-stereo circuit having a simplified structure.

To attain the above object, the present invention provides a pseudo-stereo circuit comprising an input terminal that receives an input monophonic signal to be processed, a phase-shift circuit that shifts a phase of the input monophonic signal by a phase shift amount that depends upon a frequency of the monophonic signal, to produce an output signal having a gain with respect to the input monophonic signal which is equal to or larger than a predetermined level over an entire frequency band thereof, and reaches a peak at a frequency at which the phase shift amount of the output signal with respect to the input monophonic signal assumes a value equal or closer to $-\pi$, and a mixing circuit that produces a first mixed signal by mixing a signal obtained by inverting a phase of the output signal of the phase-shift circuit with the input monophonic signal by a first mixing ratio, and produces a second mixed signal obtained by mixing the output signal of the phase-shift circuit with the input monophonic signal by a second mixing ratio, the mixing circuit generating the first mixed signal as a first audio signal carried by one of left and right channels that provide stereophonic audio signals, and generating the second mixed signal as a second audio signal carried by the other of the left and right channels.

Preferably, the phase shift amount of the output signal of the phase-shift circuit with respect to the input monophonic signal changes in a range from $0\pi$ to $-2\pi$ depending upon a frequency of the input monophonic signal.

In a preferred form, the phase-shift circuit comprises first and second phase-shift filters that are cascade-connected, Each of the first and second phase-shift filters comprises an operational amplifier having an inverting input terminal, a noninverting input terminal, and an output terminal, a time-constant circuit formed of a resistance through which an input signal of the filter is transmitted to the noninverting input terminal of the operational amplifier, and a capacitance, an input resistance through which the input signal is transmitted to the inverting input terminal of the operational amplifier, and a feedback resistance interposed between the inverting input terminal and the output terminal of the operational amplifier. A resistance value ratio of the input resistance to the feedback resistance of the first phase-shift filter is set to be greater than 1, and a resistance value ratio of the input resistance to the feedback resistance of the second phase-shift filter is set to be smaller than 1.

Preferably, the first and second phase-shift filters each shift the phase of an input signal thereof by a phase shift amount which changes in e range from $0\pi$ to $-2\pi$ depending upon a frequency of the input monophonic signal, to produce a output signal which is shifted in phase with respect to the input signal.

Also preferably, the first phase-shift filter generates an output signal which has a gain with respect to an input signal thereof, which progressively increases from 1 to a predetermined value as a frequency of the input signal increases, and the second phase-shift filter generates an output signal which has a gain with respect to an input signal thereof, which progressively decreases from 1 to a second predetermined value as a frequency of the input signal increases.

Preferably, the first predetermined value has a reciprocal thereof almost equal to the second predetermined value.

Advantageously, the phase shift amount of the first mixed signal with respect to the input monophonic signal progressively changes in a predetermined direction as a frequency of the monophonic signal changes, and the phase shift amount of the second mixed signal with respect to the input monophonic signal is maintained at an almost constant value irrespective of changes in the frequency of the monophonic signal, the first and second mixing ratios being determined so that frequency characteristics of the gains of the first and second mixed signals with respect to the input monophonic signal are substantially identical to each other over the entire frequency band.

Preferably, the first and second mixed signals each have a gain which reaches a peak at or about a frequency at which a phase difference between the first and second mixed signals is equal to $\pi$.

The above and other objects, features, and advantages of the invention will be become more apparent from the following detailed description taken in conjunction with the accompanying drawings.

DETAILED DESCRIPTION OF THE PREFERRED EMBODIMENT

The invention will now be described in detail with reference to drawings showing a preferred embodiment thereof.

Figure 3:
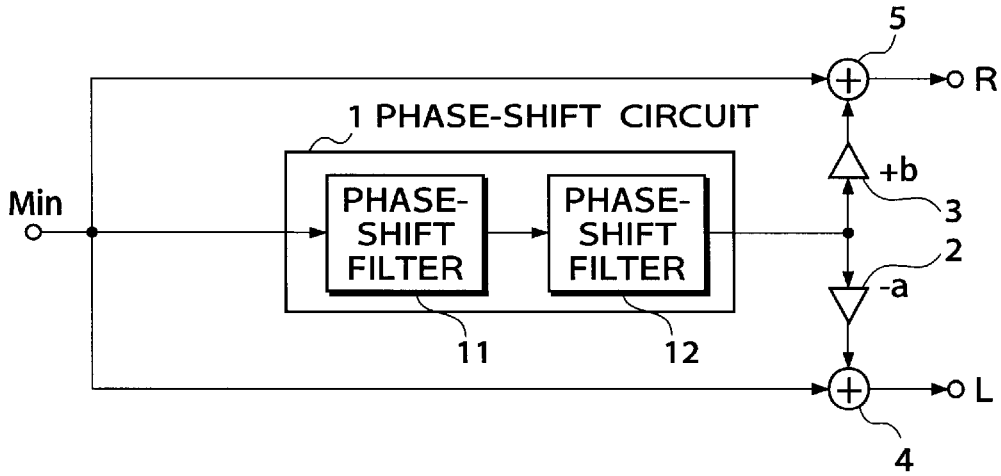
FIG. 3 is a block diagram showing the construction of a pseudo-stereo circuit according to one embodiment of the present invention.

FIG. 3 shows the construction of a pseudo-stereo circuit according to one embodiment of the invention. As shown in FIG. 3, the pseudo-stereo circuit of the present embodiment is principally comprised of a phase-shift circuit 1, multipliers 2 and 3, and adders 4, 5, and thus has a considerably simple structure.

The phase-shift circuit 1 serves to shift the phase of an input monophonic signal Min to be processed in the present embodiment, and includes two phase-shift filters 11, 12 that are cascade-connected. Each of the phase filters 11, 12 is adapted to shift the phase of an input signal thereto, such that the phase shift amount given by each of the filters 11, 12 varies in the range of 0 to $-\pi$. The gain, namely, the ratio of the output signal of each phase-shift filter 11, 12 to the corresponding input signal, is not constant for changes in the frequency of the input signal. Namely, the gain of one (11) of the phase-shift filters progressively increases from 1 to a certain value (>1) as the frequency increases, and the gain of the other phase-shift filter (12) progressively decreases from 1 to a certain value (<1) as the frequency increases. The structures of the phase-shift filters 11 and 12 will be more specifically described later.

Figure 4A:
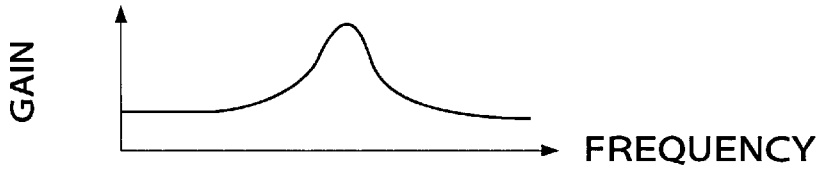
FIG. 4A is a graph showing, by way of example, the frequency characteristic of the gain of a phase-shift circuit in the pseudo-stereo circuit of FIG. 3.
Figure 4B:
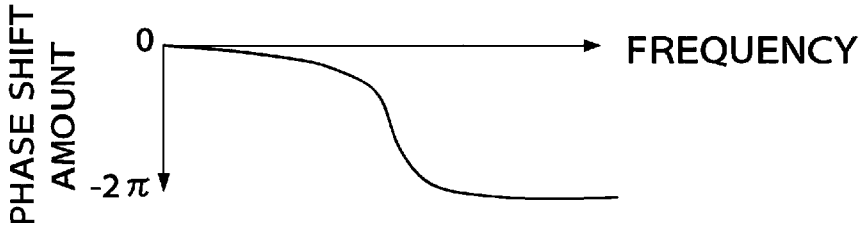
FIG. 4B is a graph showing, by way of example, the frequency characteristic of the phase shift amount of the phase-shift circuit in the pseudo-stereo circuit of FIG. 3.

FIG. 4A and FIG. 4B show respective frequency characteristics of the gain and phase shift amount of the phase-shift circuit 1 as a whole, which is comprised of the phase-shift filters 11 and 12. As indicated in FIG. 4B, the phase shift amount given to the input signal by means of the phase-shift circuit 1 varies in the range of 0 to $-\pi$, depending upon the frequency of the input signal. Also, as indicated in FIG. 4A, the gain given to the input signal by means of the phase-shift circuit 1 is kept being equal to or higher than a certain value throughout the entire frequency band, and it reaches a peak at a given frequency where the phase shift amount is approximately equal to $-\pi$.

The multiplier 2 multiplies the output signal of the phase-shift circuit 1 by a predetermined coefficient "−a". The multiplier 3, on the other hand, multiplies the output signal of the phase-shift circuit 1 by a predetermined coefficient "b". Then, the adder 4 adds the output signal of the multiplier 2 and the original input monophonic signal Min, and the adder 5 adds the output signal of the multiplier 3 and the original input monophonic signal Min. The results of addition of the adders 4, 5 are produced as stereophonic audio signals carried by two channels, i.e., L and R channels.

Figure 5A:
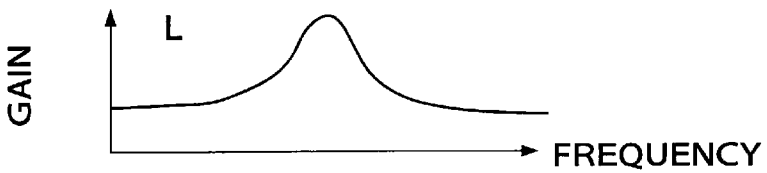
FIG. 5A is a graph showing, by way of example, the frequency characteristic of the gain of a signal processing system that produces an L-channel audio signal, in the pseudo-stereo circuit of FIG. 3.
Figure 5B:
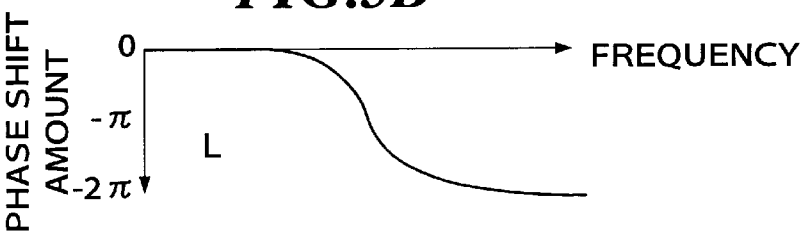
FIG. 5B is a graph showing, by way of example, the frequency characteristic of the phase shift amount of the signal processing system that produces the L-channel audio signal, in the pseudo-stereo circuit of FIG. 3.
Figure 5C:
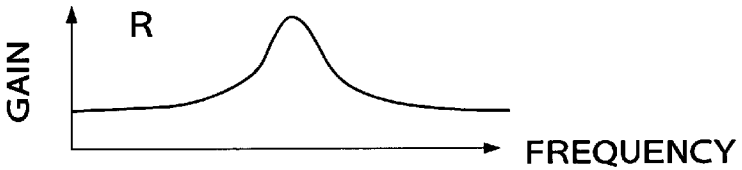
FIG. 5C is a graph showing, by way of example, the frequency characteristic of the gain of a signal processing system that produces an R-channel audio signal, in the pseudo-stereo circuit of FIG. 3.
Figure 5D:
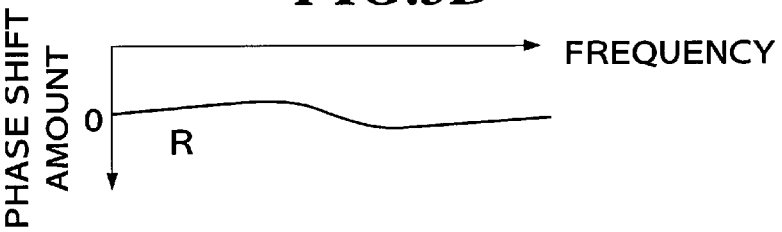
FIG. 5D is a graph showing, by way of example, the frequency characteristic of the phase-shift amount of the signal processing system that produces the R-channel audio signal, in the pseudo-stereo circuit of FIG. 3.

FIGS. 5A and 5B show respective frequency characteristics of the gain and phase shift amount of a signal processing system (comprised of the phase-shift circuit 1, multiplier 2, and adder 4) associated with production of the L-channel audio signal in the pseudo-stereo circuit of the present embodiment. FIGS. 5C and 5D show respective frequency characteristics of the gain and phase shift amount of a signal processing system (comprised of the phase-shift circuit 1, multiplier 3, and adder 5) associated with production of the R-channel audio signal.

As shown in FIG. 5B, the phase shift amount of the signal processing system that produces the L-channel audio signal varies in the range of 0 to $-2\pi$, depending upon the frequency of the input signal. As shown in FIG. 5A by way of example, the gain of the signal processing system for producing the L-channel audio signal is kept being equal to or larger than a certain value throughout the entire frequency band, and it reaches a peak at a given frequency where the phase shift amount is approximately equal to $-\pi$.

On the other hand, the phase shift amount of the signal processing system that produces the R-channel audio signal is almost 0 and hardly changes throughout the entire frequency band, as shown in FIG. 5D. However, the frequency characteristic of the gain of the signal processing system for producing the R-channel audio signal is substantially the same as that of the gain of the signal processing system for producing the L-channel audio signal, as shown in FIG. 5C.

The frequency characteristics of the respective signal processing systems as described above can be obtained by suitably controlling the multiplication coefficients "−a" and "b" of the multipliers 2 and 3.

In the present embodiment having the above-described frequency characteristics, the input monophonic signal Min is converted into audio signals of L and R channels whose intensity ratio and phase difference depend upon the frequency of the input signal Min, and these audio signals are generated from the respective adders 4, 5. In this case, the gains of both of the signal processing systems for producing the audio signals of the L and R channels reach their peaks, at around the frequency where the phase difference of the L-channel audio signal and the R-channel audio signal is approximately equal to $\pi$. This arrangement can avoid destructive interference (in which the sounds of the L and R channels cancel each other in the air, and cannot be heard), which would otherwise occur when a sound speaker generates sound represented by audio signals of L and R channels having a phase difference of $\pi$. Thus, the pseudo-stereo circuit of the present embodiment has a remarkably simple structure as shown in FIG. 3, and still provides such a good performance as that of the known pseudo-stereo circuit.

Figure 6:
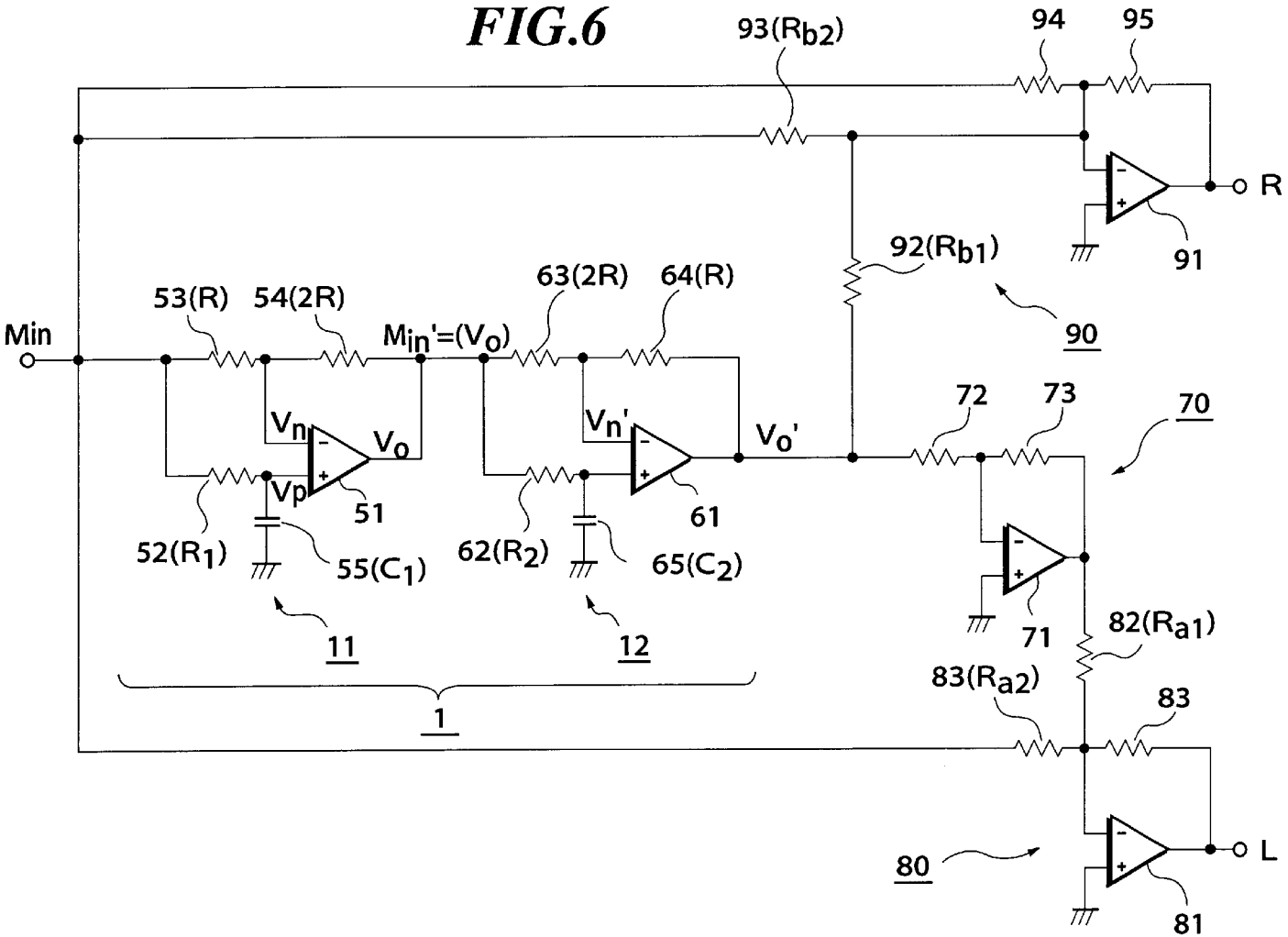
FIG. 6 is a circuit diagram showing the construction of a specific example of the pseudo-stereo circuit of FIG. 3.

Referring next to FIG. 6, a specific example of the circuitry of the pseudo-stereo circuit according to the present embodiment will be now described. In FIG. 6, the same reference numerals as used in FIG. 3 are used for identifying corresponding components or elements, so as to clarify the relationship with the known circuitry of FIG. 3 described above.

Figure 1:
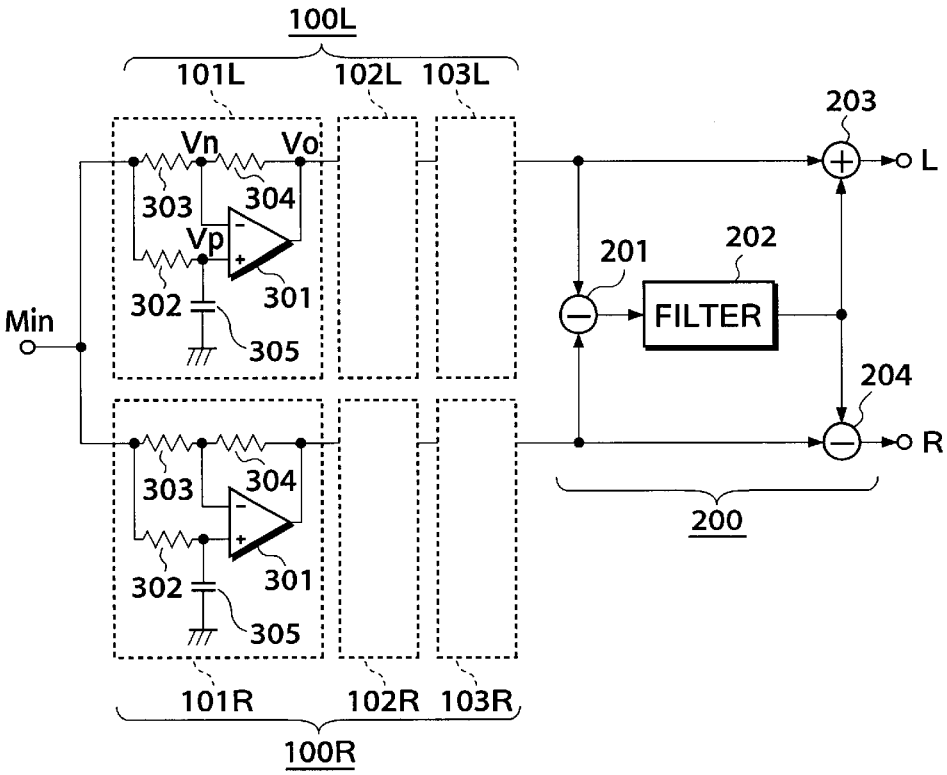
FIG.1 PRIOR ART
FIG. 1 is a block diagram showing the construction of a known pseudo-stereo circuit.
Figure 2:
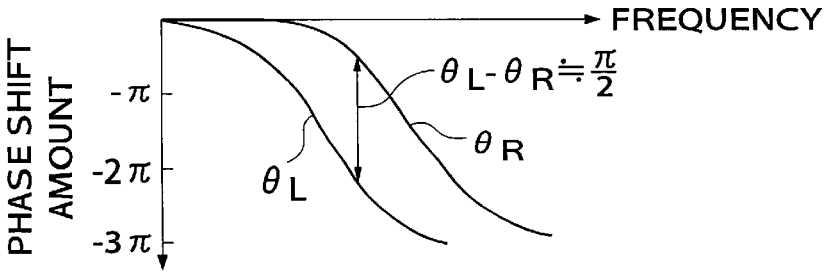
FIG.2 PRIOR ART
FIG. 2 is a graph showing frequency characteristics of phase-shift circuits corresponding to two channels, i.e., L channel and R channel, in the pseudo-stereo circuit of FIG. 1.

In FIG. 6, the phase-shift filter 11 is comprised of an operational amplifier 51, resistors 52–54 and a capacitor 55. In the phase-shift filter 11, the input monophonic signal Min enters the noninverting input terminal (+) of the operational amplifier 51, through a time-constant circuit (RC circuit) formed of the resistor 52 and the capacitor 55, and also enters the inverting input terminal (−) of the operational amplifier 51 through the resistor 53. Also, the output signal of the operational amplifier 51 is fed back to the inverting input terminal (−) through the resistor 54. In the above-described all-pass filter 101L shown in FIG. 1, the input resistor 303 on the side of the inverting input terminal (−) and the feedback resistor 304 have the same resistance value. In the phase-shift filter 11, however, the resistance value of the feedback resistor 54 of the operational amplifier 51 is twice as large as that of the input resistor 53 on the side of the inverting input terminal (−). Other than this aspect, the phase-shift filter shown in FIG. 6 has the same structure or arrangement as the all-pass filter 101L of FIG. 1.

In the circuit described above, if the resistance value of the resistor 53 is designated by R, and the resistance value of the resistor 54 2R, the following expression (7) is established:

$$(\mathrm{Min}-Vn)/R=(Vn-Vo)/(2R) \tag{7}$$

where Vn represents the input voltage of the inverting input terminal (−) of the operational amplifier 51, and Vo the output voltage of the operational amplifier 51.

Accordingly, the input voltage Vn of the inverting input terminal (−) of the operational amplifier 51 is given by the following expression (8):

$$Vn=(2\mathrm{Min}+Vo)/3 \tag{8}$$

On the other hand, the input voltage Vp of the noninverting input terminal (+) of the operational amplifier 51 is given by the following expression (9):

$$Vp=\mathrm{Min}/(1+j\omega C1R1) \tag{9}$$

where R1 represents the resistance value of the resistor 52, C1 the capacitance value of the capacitor 55, and ω the angular frequency of the input monophonic signal Min.

Since the input voltage Vp is equal to the input voltage Vn due to the feedback operation in the phase-shift filter 11, the following expression (10) is established:

$$(2\mathrm{Min}+Vo)/3=\mathrm{Min}/(1+j\omega C1R1) \tag{10}$$

By transforming the above expression (10), the transfer function H1 of the phase-shift filter 11 is obtained as follows:

$$\begin{aligned} H1 &= Vo/\mathrm{Min} \\ &= (1-2j\omega C1R1)/(1+j\omega C1R1) \end{aligned} \tag{11}$$

From the above expression (11), the phase shift amount θ1 of the phase-shift filter 11 is obtained as follows:

$$\begin{aligned} \theta 1 &= arg(H1) \\ &= -\tan^{-1}2\omega C1R1-\tan^{-1}\omega C1R1 \end{aligned} \tag{12}$$

It will be understood from the above expression (12) that the phase shift amount θ1 of the phase-shift filter 11 changes from 0 to −π while the angular frequency ω changes from zero to infinity (∞).

The gain G1 of the phase-shift filter 11 is also obtained from the above expression (10), as follows:

$$\begin{aligned} G1 &= |H1| \\ &= \{(1+(2\omega C1R1)^2)/(1+(\omega C1R1)^2)\}^{1/2} \end{aligned} \tag{13}$$

It will be understood from the above expression (13) that the gain G1 of the phase-shift filter 11 changes from 1 to 2 while the angular frequency ω changes from zero to infinity (∞).

The phase-shift filter 12 is comprised of an operational amplifier 61, resistors 62–64 and a capacitor 65. The phase-shift filter 12 has substantially the same structure as the above-described phase-shift filter 11, except that the input resistor 63 on the side of the inverting input terminal (−) of the operational amplifier 61 has a resistance value that is twice as large as that of the feedback resistor 64.

Since the resistance value of the input resistor 63 is twice as large as that of the feedback resistor 64 in the phase-shift filter 12, the input voltage Vn' of the inverting input terminal (−) is given as follows:

$$Vn'=(\mathrm{Min}'+2Vo')/3 \tag{14}$$

where Min' represents the input signal received by the phase-shift filter 12, and Vo' the output signal of the phase-shift filter 12.

Based on the above expression (14), the transfer function H2 of the phase-shift filter 12 is obtained by similar calculations as performed in the case of the phase-shift filter 11, as follows:

$$\begin{aligned} H2 &= Vo'/\mathrm{Min}' \\ &= (1-j(\omega C2R2/2))/(1+j\omega C2R2) \end{aligned} \tag{15}$$

From the above expression (15), the phase shift amount θ2 of the phase-shift filter 12 is given by the following expression (16):

$$\begin{aligned} \theta 2 &= arg(H2) \\ &= -\tan^{-1}(\omega C2R2/2)-\tan^{-1}\omega C2R2 \end{aligned} \tag{16}$$

It will be understood from the above expression (16) that the phase shift amount θ2 of the phase-shift filter 12 also changes from 0 to −π while the angular frequency ω changes from zero to infinity (∞).

The gain G2 of the phase-shift filter 12 is also derived from the above expression (15), as follows:

$$\begin{aligned} G2 &= |H2| \\ &= \{(1+(\omega C2R2/2)^2)/(1+(\omega C2R2)^2)\}^{1/2} \end{aligned} \tag{17}$$

It will be understood from the above expression (17) that the gain G2 of the phase-shift filter 12 changes from 1 to ½ while the angular frequency ω changes from zero to infinity (∞).

Next, the phase shift amount θ and gain G of the phase-shift circuit 1 as a whole that is comprised of the phase-shift filters 11 and 12 will be now explained.

The phase shift amount θ of the phase-shift circuit 1 as a whole is derived from the above expressions (12) and (16), as follows:

$$\theta = \theta 1 + \theta 2 \tag{18}$$

$$= -\tan^{-1} 2\omega C1R1 - \tan^{-1}\omega C1R1 - \tan^{-1}(\omega C2R2/2) - \tan^{-1}\omega C2R2$$

Thus, the phase shift amount θ changes from 0 to −2π while the angular frequency ω changes from zero to infinity (∞).

The gain G of the whole phase-shift circuit 1 is derived from the above expressions (13) and (17), as follows:

$$G = G1G2 \tag{19}$$

$$= \{(1 + (2\omega C1R1)^2)\ (1 + (\omega C1R1)^2/(1 + ((\omega C1R1)^2)(1 + (\omega C2R2)^2)\})^{1/2}$$

$$= \{(1 + 4\omega^2 C1^2 R1^2 + \omega^2 C2^2 R2^2/4 + \omega^4 C1^2 R1^2 C2^2 R2^2)/(1 + \omega^2 C1^2 R1^{-2} + \omega^2 C2^2 R2^2 + (\omega^4 C1^2 R1^2 C2^2 R2^2)\})^{1/2}$$

As already explained above, while the angular frequency ω changes from zero to infinity (∞), the gain G1 of the phase-shift filter 11 changes from 1 to 2, and the gain G2 of the phase-shift filter 12 changes from 1 to ½. Accordingly, the gain G of the whole phase-shift circuit 1 given by the above expression (19) increases from 1 as the angular frequency ω increases from 0, and reaches a peak value at a certain angular frequency ω0. The gain G of the phase-shift circuit 1 then decreases as the angular frequency ω increases, and becomes equal to 1 when the angular frequency goes to infinity (∞).

The angular frequency ω0 at which the gain G reaches the peak can be obtained by calculating dG/dω based on the above expression (19), and solving the equation dG/dω=0 with respect to ω. The result of the calculation is expressed as follows:

$$\omega 0 = \{(12C1^2R1^2 - 3C2^2R2^2)/(12C1^4R1^4C2^2R2^2 - 3C1^2R1^2C2^4R2^4)\}^{1/4} \tag{20}$$

For the sake of simplicity, the condition:

$$C1R1 = C2R2 = \tau \tag{21}$$

is now added. Under this condition, the following expression (22) is derived from the above expression (20):

$$\omega 0 = 1/\tau \tag{22}$$

If the above-indicated ω0 is substituted for ω in the above expression (18), under the above condition (21), the phase shift amount θ of the phase-shift circuit 1 is given by the following expression (23):

$$\theta = -\tan^{-1} 2 - \tan^{-1} 1 - \tan^{-1}(1/2) - \tan^{-1} 1 \tag{23}$$

$$= -\pi$$

In the circuit shown in FIG. 6, the phase shift amount θ of the phase-shift circuit 1 becomes equal to −π and the gain G reaches its peak when the angular frequency ω of the input monophonic signal Min is equal to ω0=1/τ.

The phase-shift circuit 1 has been described above in detail. While the frequency at which the phase shift amount θ of the phase-shift circuit 1 becomes equal to −π precisely coincides with the frequency at which the gain G reaches its peak in the example of the circuit shown in FIG. 6, these frequencies need not strictly coincide with each other, and the effect or advantages of the present embodiment can be obtained provided that the difference between these frequencies is sufficiently small.

A signal processing system will be now described which produces stereophonic audio signals of L and R channels, from the output signal of the phase-shift circuit 1 and the input monophonic signal.

A phase inverter circuit 70 is comprised of an operational amplifier 71 and resistors 72 and 73. The phase inverter circuit 70 serves to invert the phase of the output signal of the phase-shift circuit 1, and generates the resulting signal to a multiplier/adder 80 in the next stage.

The multiplier/adder 80 is comprised of an operational amplifier 81 and resistors 82–83. The multiplier/adder 80 multiplies the output signal of the phase inverter circuit 70 and the input monophonic signal Min by respective coefficients, adds the results of multiplication together, and outputs the resulting signal as an L-channel audio signal. The above-described phase inverter circuit 70 and the multiplier/adder 80 correspond to the multiplier 2 and the adder 4 shown in FIG. 3. The coefficient by which the multiplier/adder 80 multiplies the output signal of the phase inverter circuit 70 can be adjusted by suitably selecting the resistance value Ra1 of the resistor 82, and the coefficient by which the multiplier/adder 80 multiplies the input monophonic signal Min can be adjusted by suitably selecting the resistance value Ra2 of the resistor 83.

A multiplier/adder 90 is comprised of an operational amplifier 91 and resistors 92–95. The multiplier/adder 90 multiplies the output signal of the phase-shift circuit 1 and the input monophonic signal Min by respective coefficients, adds the results of multiplication together, and outputs the resulting signal as an R-channel audio signal. Thus, the multiplier/adder 90 correspond to the multiplier 3 and the adder 5 shown in FIG. 3. The coefficients by which the output signal of the phase-shift circuit 1 and the input monophonic signal Min are multiplied can be respectively adjusted by suitably selecting the resistance value Rb1 of the resistor 92 and the resistance value Rb2 of the resistor 93. The multiplication coefficients of the multiplier/adder 90 and the multiplication coefficients of the multiplier/adder 80 are respectively set to such optimum values that the frequency characteristics as shown in FIG. 5A through FIG. 5D can be obtained.

Figure 7:
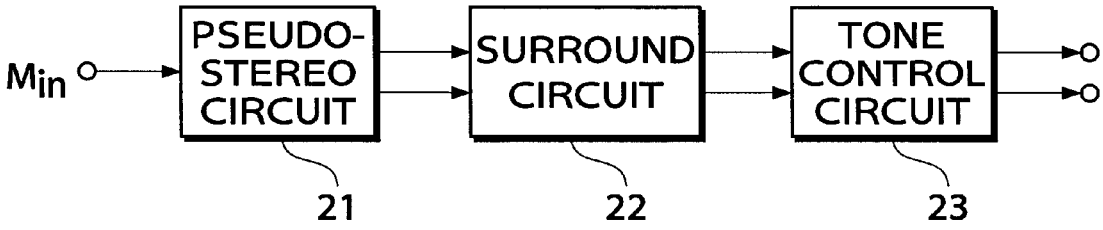
FIG. 7 is a block diagram showing the arrangement of a surround system as an example in which the pseudo-stereo circuit of FIG. 3 is used.

FIG. 7 schematically shows a surround system as a specific example in which the pseudo-stereo circuit of the present embodiment described above is used, wherein the pseudo-stereo circuit 21, a surround circuit 22, and a tone control circuit 23 are cascade-connected in this order. Since the pseudo-stereo circuit 21 of the present embodiment is relatively simple in construction and small in size, as compared with the known counterpart, the surround system as a whole is available at a reduced cost. Furthermore, the pseudo-stereo circuit of the present embodiment provides such a good performance as that of the known circuit, in spite of a reduced number of components, and therefore the surround system including the present pseudo-stereo circuit has a high performance, and is available at a relatively low cost.

What is claimed is:

1. A pseudo-stereo circuit comprising:

an input terminal that receives an input monophonic signal to be processed;

a phase-shift circuit that shifts a phase of the input monophonic signal by a phase shift amount that depends upon a frequency of the monophonic signal such that the phase changes from an angle of zero to a predetermined angle of $-2\pi$ as the frequency of the monophonic signal increases, to produce an output signal having a gain with respect to the input monophonic signal which is equal to or larger than a predetermined level over an entire frequency band thereof, and which reaches a peak at a frequency at which the phase shift amount of the output signal with respect to the input monophonic signal assumes a value equal or closer to $-1\pi$; and a mixing circuit that produces a first mixed signal by mixing a signal obtained by inverting a phase of the output signal of said phase-shift circuit with the input monophonic signal by a first mixing ratio, and produces a second mixed signal obtained by mixing the output signal of the phase-shift circuit with the input monophonic signal by a second mixing ratio, said mixing circuit generating said first mixed signal as a first audio signal carried by one of left and right channels that provide stereophonic audio signals, and generating said second mixed signal as a second audio signal carried by the other of the left and right channels.

2. A pseudo-stereo circuit according to claim 1, wherein the phase shift amount of the output signal of the phase-shift circuit with respect to the input monophonic signal changes in a range from $0\pi$ to $-2\pi$ depending upon a frequency of the input monophonic signal.

3. A pseudo-stereo circuit according to claim 1, wherein said phase-shift circuit comprises first and second phase-shift filters that are cascade-connected;

wherein each of said first and second phase-shift filters comprises an operational amplifier having an inverting input terminal, a noninverting input terminal, and an output terminal, a time-constant circuit formed of a resistance through which an input signal of the filter is transmitted to the noninverting input terminal of the operational amplifier, and a capacitance, an input resistance through which the input signal is transmitted to the inverting input terminal of the operational amplifier, and a feedback resistance interposed between the inverting input terminal and the output terminal of the operational amplifier; and wherein a resistance value ratio of the input resistance to the feedback resistance of the first phase-shift filter is set to be greater than 1, and a resistance value ratio of the input resistance to the feedback resistance of the second phase-shift filter is set to be smaller than 1.

4. A pseudo-stereo circuit according to claim 3, wherein the first and second phase-shift filters each shift the phase of an input signal thereof by a phase shift amount which changes in a range from $0\pi$ to $-2\pi$ depending upon a frequency of the input monophonic signal, to produce a output signal which is shifted in phase with respect to the input signal.

5. A pseudo-stereo circuit according to claim 3, wherein the first phase-shift filter generates an output signal which has a gain with respect to an input signal thereof, which progressively increases from 1 to a first predetermined value as a frequency of the input signal increases, and the second phase-shift filter generates an output signal which has a gain with respect to an input signal thereof, which progressively decreases from 1 to a second predetermined value as a frequency of the input signal increases.

6. A pseudo-stereo circuit according to claim 5, wherein the first predetermined value has a reciprocal thereof almost equal to the second predetermined value.

7. A pseudo-stereo circuit according to claim 1, wherein the phase shift amount of the first mixed signal with respect to the input monophonic signal progressively changes in a predetermined direction as a frequency of the monophonic signal changes, and the phase shift amount of the second mixed signal with respect to the input monophonic signal is maintained at an almost constant value irrespective of changes in the frequency of the monophonic signal, said first and second mixing ratios being determined so that frequency characteristics of the gains of the first and second mixed signals with respect to the input monophonic signal are substantially identical to each other over the entire frequency band.

8. A pseudo-stereo circuit according to claim 7, wherein the first and second mixed signals each have a gain which reaches a peak at or about a frequency at which a phase difference between the first and second mixed signals is equal to $\pi$.

9. A pseudo-stereo circuit according to claim 7, wherein said phase-shift circuit comprises first and second phase-shift filters that are cascade-connected;

wherein each of said first and second phase-shift filters comprises an operational amplifier having an inverting input terminal, a noninverting input terminal, and an output terminal, a time-constant circuit formed of a resistance through which an input signal of the filter is transmitted to the noninverting input terminal of the operational amplifier, and a capacitance, an input resistance through which the input signal is transmitted to the inverting input terminal of the operational amplifier, and a feedback resistance interposed between the inverting input terminal and the output terminal of the operational amplifier; and wherein a resistance value ratio of the input resistance to the feedback resistance of the first phase-shift filter is set to be greater than 1, and a resistance value ratio of the input resistance to the feedback resistance of the second phase-shift filter is set to be smaller than 1.

10. A pseudo-stereo circuit comprising:

an input terminal that receives an input monophonic signal to be processed;

a phase-shift circuit that shifts a phase of the input monophonic signal by a phase shift amount that depends upon a frequency of the monophonic signal, to produce an output signal having a gain with respect to the input monophonic signal which is equal to or larger than a predetermined level over an entire frequency band thereof, and reaches a peak at a frequency at which the phase shift amount of the output signal with respect to the input monophonic signal assumes a value equal or closer to $-\pi$, and a mixing circuit that produces a first mixed signal by mixing a signal obtained by inverting a phase of the output signal of said phase-shift circuit with the input monophonic signal by a first mixing ratio, and produces a second mixed signal obtained by mixing the output signal of the phase-shift circuit with the input monophonic signal by a second mixing ratio, said mixing circuit generating said first mixed signal as a first audio signal carried by one of left and right channels that provide stereophonic audio signals, and generating said second mixed signal as a second audio signal carried by the other of the left and right channels, wherein the phase shift amount of the first mixed signal with respect to the input monophonic signal progressively changes in a predetermined direction as a frequency of the monophonic signal changes, and the phase shift amount of the second mixed signal with respect to the input monophonic signal is maintained at an almost constant value irrespective of changes in the frequency of the monophonic signal, said first and second mixing ratios being determined so that frequency characteristics of the gains of the first and second mixed signals with respect to the input monophonic signal are substantially identical to each other over the entire frequency band.

11. A pseudo-stereo circuit according to claim 10, wherein the first and second mixed signals each have a gain which reaches a peak at or about a frequency at which a phase difference between the first and second mixed signals is equal to $\pi$.

12. A pseudo-stereo circuit according to claim 10, wherein said phase-shift circuit comprises first and second phase shift filters that are cascade-connected;

wherein each of said first and second phase-shift filters comprises an operational amplifier having an inverting input signal, a noninverting input terminal, and an output terminal, a time-constant circuit formed of a resistance through which an input signal of the filter is transmitted to the noninverting input terminal of the operational amplifier, and a capacitance, an input resistance through which the input signal is transmitted to the inverting input terminal of the operational amplifier, and a feedback resistance interposed between the inverting input terminal and the output terminal of the operational amplifier, and wherein a resistance value ratio of the input resistance to the feedback resistance of the first phase-shift filter is set to be greater than 1, and a resistance value ratio of the input resistance to the feedback resistance of the second phase-shift filter is set to be smaller than 1.

* * * * *